US008465601B2

(12) United States Patent
Im et al.

(10) Patent No.: US 8,465,601 B2
(45) Date of Patent: Jun. 18, 2013

(54) HIGH CARBON STEEL SHEET SUPERIOR IN TENSILE STRENGTH AND ELONGATION AND METHOD FOR MANUFACTURING THE SAME

(75) Inventors: Young-Roc Im, Pohang-si (KR); Jae-Kon Lee, Pohang-si (KR); Kyoo-Young Lee, Suncheon-si (KR); Yeong-Woo Jeon, Pohang-si (KR); Jae-Hwa Ryu, Pohang-si (KR); Kyong-Su Park, Pohang-shi (KR)

(73) Assignee: POSCO, Pohang-shi (KR)

( * ) Notice: Subject to any disclaimer, the term of this patent is extended or adjusted under 35 U.S.C. 154(b) by 292 days.

(21) Appl. No.: 12/745,621

(22) PCT Filed: Dec. 5, 2008

(86) PCT No.: PCT/KR2008/007211

§ 371 (c)(1),
(2), (4) Date: Jun. 1, 2010

(87) PCT Pub. No.: WO2009/075494

PCT Pub. Date: Jun. 18, 2009

(65) Prior Publication Data

US 2010/0307641 A1 Dec. 9, 2010

(30) Foreign Application Priority Data

Dec. 6, 2007 (KR) ..... 10-2007-0126202
Mar. 20, 2008 (KR) ..... 10-2008-0025717
Dec. 4, 2008 (KR) ..... 10-2008-0122489

(51) Int. Cl.

| | |
|---|---|
| ***C22C 38/58*** | (2006.01) |
| ***C22C 38/50*** | (2006.01) |
| ***C22C 38/06*** | (2006.01) |
| ***C22C 38/02*** | (2006.01) |
| ***C21D 9/00*** | (2006.01) |

(52) U.S. Cl.
USPC ..... 148/335; 148/330; 148/506; 148/507; 148/661

(58) Field of Classification Search
USPC ..... 148/320, 333–336, 505–507, 579, 148/601, 660–662, 330
See application file for complete search history.

(56) References Cited

U.S. PATENT DOCUMENTS

2007/0079912 A1* 4/2007 Beguinot ..... 148/660
2008/0295923 A1 12/2008 Lee et al.
2009/0071578 A1 3/2009 Nakamura et al.

FOREIGN PATENT DOCUMENTS

CN 1598032 A 3/2005
CN 1721565 A 1/2006

(Continued)

OTHER PUBLICATIONS

Xu Ji-Peng et al., "Influence of Austempering Processing on Microstructure and Mechanical Property of Austenitic-bainitic Cast Steel", Foundry, Nov. 2002, pp. 680-683, vol. 51, No. 11.

(Continued)

*Primary Examiner* — Deborah Yee
(74) *Attorney, Agent, or Firm* — The Webb Law Firm

(57) ABSTRACT

A high carbon steel sheet having superior strength and ductility and a method for manufacturing the same comprising: 0.2 to 1.0 wt % carbon (C), 0 to 3.0 wt % silicon (Si), 0 to 3.0 wt % manganese (Mn), 0 to 3.0 wt % chromium (Cr), 0 to 3.0 wt % nickel (Ni), 0 to 0.5 wt % molybdenum (Mo), 0 to 3.0 wt % aluminum (Al), 0 to 0.01 wt % boron (B), 0 to 0.5 wt % titanium (Ti), and the remainder substantially being iron (Fe) and inevitable impurities. The contents of carbon, manganese, chromium, and nickel satisfy the following Equation 1, and the contents of silicon and aluminum satisfy the following Equation 2: $(3.0-2.5\times C)$wt %$\leqq$(Mn+Cr+Ni/2)$\leqq$8.5 wt %—(Equation 1) Si+Al>1.0 wt % (Equation 2).

17 Claims, 2 Drawing Sheets

FOREIGN PATENT DOCUMENTS

| | | | | |
|---|---|---|---|---|
| EP | 0003208 | A1 | * | 7/1979 |
| JP | 4032512 | A | | 2/1992 |
| JP | 405320749 | A | * | 12/1993 |
| JP | 2000144311 | A | | 5/2000 |
| JP | 2005133199 | A | | 5/2005 |
| JP | 2005290547 | A | | 10/2005 |
| JP | 2006097109 | A | | 4/2006 |
| JP | 2006265604 | A | | 10/2006 |
| JP | 2006299344 | A | | 11/2006 |
| KR | 20030016434 | A | | 3/2003 |
| KR | 20070068289 | A | | 6/2007 |
| KR | 1020070067328 | A | | 6/2007 |

OTHER PUBLICATIONS

Xu Hongxin et al., "Influence of Nitrogen Content and Trace Titanium on Hardenability of 20CrMnB Steel", Iron and Steel, May 1993, pp. 44-48, vol. 28, No. 5.

Yao, Zhengxing, "10th Lesson Diffusion Transformation (Four)—Bainite Transformation", Shanghai Steel & Iron Research, Dec. 31, 1983, pp. 49-54, China Academic Journal Electronic Publishing House, including English translation of Abstract.

* cited by examiner

HIGH CARBON STEEL SHEET SUPERIOR IN TENSILE STRENGTH AND ELONGATION AND METHOD FOR MANUFACTURING THE SAME

TECHNICAL FIELD

The present invention relates to a high carbon steel sheet and a method for manufacturing the same. More particularly, the present invention relates to a high carbon steel sheet having superior strength and ductility and a method for manufacturing the same.

BACKGROUND ART

A mixed structure of fine bainite and residual austenite can be obtained by transforming a high-carbon high-alloy steel at a low temperature, and a steel sheet having superior strength and elongation percentage can be manufactured using such a fine structure.

However, to obtain bainite transformation at a low temperature, a very long transformation time of more than one week is required. Thus, such a steel sheet is not appropriate for mass production because the phase transformation speed of bainite is too slow.

The above information disclosed in this Background section is only for enhancement of understanding of the background of the invention and therefore it may contain information that does not form the prior art that is already known in this country to a person of ordinary skill in the art.

DETAILED DESCRIPTION

Summary of the Invention

The present invention provides a high carbon steel sheet that can be manufactured within a short time and has superior strength and ductility. Additionally, the present invention provides a method for manufacturing the aforementioned high carbon steel sheet.

A high carbon steel sheet according to one exemplary embodiment of the present invention includes 0.2 to 1.0 wt % carbon (C), 0 to 3.0 wt % silicon (Si), 0 to 3.0 wt % manganese (Mn), 0 to 3.0 wt % chromium (Cr), 0 to 3.0 wt % nickel (Ni), 0 to 0.5 wt % molybdenum (Mo), 0 to 3.0 wt % aluminum (Al), 0 to 0.01 wt % boron (B), 0 to 0.5 wt % titanium (Ti), and the remainder substantially being iron (Fe) and inevitable impurities. The contents of carbon, manganese, chromium, and nickel satisfy the following Equation 1, and the contents of silicon and aluminum satisfy the following Equation 2.

$$(3.0-2.5\times C)\text{wt }\% \leqq (Mn+Cr+Ni/2) \leqq 8.5\text{ wt }\% \quad \text{(Equation 1)}$$

$$Si+Al \geqq 1.0\text{ wt }\% \quad \text{(Equation 2)}$$

The high carbon steel sheet has a fine microstructure, the fine microstructure includes austenite, and the volume percentage of residual austenite in the fine microstructure may be from 15 wt % to 50 wt %. The fine microstructure further includes bainite, and the bainite may be included at 50 vol % to 85 vol %. The tensile strength of the high carbon steel sheet may be greater than 1000 MPa, and the elongation percentage thereof may be greater than 10%.

In the present invention, for mass production of the high carbon steel sheet including a hot rolling process, the time taken for more than 50% of the steel to be transformed into bainite is reduced so that the transformation can be finished within a maximum of 48 hours, and preferably within less than three hours. To this end, a condition for controlling the contents of C, Mn, Cr, Ni, Si, and Al and the bainite transformation temperature is suggested. In the condition that allows the time for 50% transformation into bainite to be less than a maximum of 48 hours, and preferably less than three hours, the contents of C, Mn, Cr, Ni, and Al, and the bainite transformation temperature can be expressed by the following Equation 3.

$$\text{Log }10[50\%\text{ transformation time(sec)}] = -2.742 + 3.561\times C + 0.820\times Mn + 0.416\times Cr + 0.402\times Ni - 0.332\times Al + 1330/T + 273 \leqq \text{Log }10[3\times 3600] \quad \text{(Equation 3)}$$

Here, T is a temperature in degrees Celsius and represents a transformation temperature, and 50% transformation time is a minimum time required for 50% transformation into bainite.

Preferably, the transformation temperature is set from a bainite transformation starting temperature Bs to Bs−150° C. C. If higher than Bs, no bainite transformation can be obtained, and if lower than Bs−150° C., the amount of residual austenite decreases making it difficult to obtain an elongation percentage of more than 10%, and the transformation speed slows and increases the 50% transformation time.

The bainite transformation starting temperature satisfies the following Equation 4.

$$\text{The bainite transformation starting temperature}(Bs)(^\circ\text{C.}) = 830 - 270\times C(\text{wt }\%) - 90\times Mn(\text{wt }\%) - 37\times Ni(\text{wt }\%) - 70\times Cr(\text{wt }\%)\times 83\times Mo(\text{wt }\%) \quad \text{(Equation 4)}$$

A method for manufacturing a high carbon steel sheet according to one exemplary embodiment of the present invention includes: i) preparing a high carbon steel sheet including 0.2 to 1.0 wt % carbon (C), 0 to 3.0 wt % silicon (Si), 0 to 3.0 wt % manganese (Mn), 0 to 3.0 wt % chromium (Cr), 0 to 3.0 wt % nickel (Ni), 0 to 0.5 wt % molybdenum (Mo), 0 to 3.0 wt % aluminum (Al), 0 to 0.01 wt % boron (B), 0 to 0.5 wt % titanium (Ti), and the remainder substantially being iron (Fe) and inevitable impurities; ii) austenitizing the high carbon steel sheet; iii) cooling the high carbon steel sheet while maintaining the austenite structure; and iv) isothermally transforming the austenitized high carbon steel sheet in a temperature range from 150° C. below the bainite transformation starting temperature to the bainite transformation starting temperature. Here, the contents of carbon, manganese, chromium, and nickel satisfy the following Equation 1, and the contents of silicon and aluminum satisfy the following Equation 2.

$$(3.0-2.5\times C)\text{wt }\% \leqq (Mn+Cr+Ni/2) \leqq 8.5\text{ wt }\% \quad \text{(Equation 1)}$$

$$Si+Al \geqq 1.0\text{ wt }\% \quad \text{(Equation 2)}$$

Preferably, the components and transformation temperature of the steel sheet are controlled as in the following Equation 3 in order to make the transformation time required for 50% transformation into bainite less than three hours.

$$\text{Log }10[50\%\text{ transformation time(sec)}] = -2.742 + 3.561\times C + 0.820\times Mn + 0.416\times Cr + 0.402\times Ni - 0.332\times Al + 1330/T + 273 \leqq \text{Log }10[3\times 3600] \quad \text{(Equation 3)}$$

In the isothermal transforming of the high carbon steel sheet, an isothermal transformation heat treatment time is required to obtain a sufficient bainite transformation amount, however, the time required to obtain more than 50 vol % bainite transformation of the high carbon steel sheet is a maximum of 48 hours, and preferably less than three hours, considering mass production. During the isothermal transformation, the bainite transformation of the high carbon steel sheet may be completed at greater than 50 vol % and less than 100 vol %.

In the case of a hot rolled steel sheet, isothermal transformation may be performed in the process of cooling the hot rolled steel sheet at a temperature between a bainite transformation starting temperature Bs and Bs−150° C., coiling it, and cooling it down to the ambient temperature. In this way, if a hot rolled steel sheet is rolled and undergoes isothermal transformation, an isothermal transformation effect can be achieved for a maximum of 48 hours, and preferably 3 hours, by a heat retention effect inside the roll, and mass production using a hot rolling process is enabled.

The high carbon steel sheet includes an ideal fine microstructure comprising bainite and residual austenite formed through the isothermal transformation process.

Accordingly, the strength and ductility of the high carbon steel sheet are excellent. Further, it is possible to obtain a target fine microstructure through a short-time isothermal transformation by adjusting the alloy components of the high carbon steel sheet, such as the content of carbon, and adding aluminum.

Further, an alloy that can be manufactured by a hot rolling process can be designed by quantifying the relationship between the content of each alloy element and the transformation temperature. Further, a fine structure made of bainite and residual austenite can be formed by restricting the relationship among C, Mn, Cr, and Ni and their content ranges. As a result, the strength and ductility of the high carbon steel sheet can be improved.

DETAILED DESCRIPTION OF THE INVENTION

The terminology used herein is intended to describe only particular exemplary embodiments of the present invention, not to limit the present invention. Herein, the singular forms "a", "an", and "the" are intended to include the plural forms as well, unless the context clearly indicates otherwise. Also, the terms "comprise" and "include" specify the presence of stated features, numbers, steps, operations, elements, and/or components, but do not preclude the presence or addition of one or more other features, numbers, steps, operations, elements, components, and/or groups thereof.

Unless explicitly defined otherwise, all terms (including technical and scientific terms) used herein have the same meaning as commonly understood by one of ordinary skill in the art to which the present invention pertains. Terms defined in common dictionaries should be interpreted as having meanings consistent with the context of the specification and the relevant art, and should not be interpreted in an idealized or overly formal sense unless expressly so defined herein.

Hereinafter, an exemplary embodiment of the present invention will be described in detail with reference to FIGS. 1 to 3. This embodiment is provided to exemplify the present invention, which is not limited to any particular embodiment.

Figure 1:
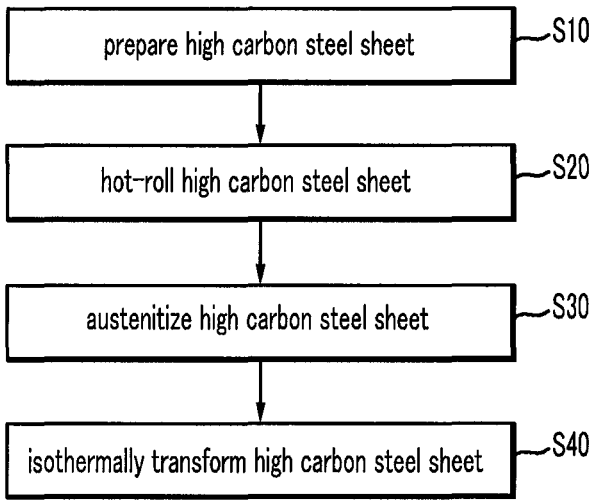
FIG. 1 is a flowchart schematically showing a method for manufacturing a high carbon steel sheet according to one exemplary embodiment of the present invention.

FIG. 1 is a flowchart schematically showing a method for manufacturing a high carbon steel sheet according to one exemplary embodiment of the present invention.

As shown in FIG. 1, the method for manufacturing a high carbon steel sheet comprises a step S10 of preparing a high carbon steel sheet, a step S20 of hot-rolling the high carbon steel sheet, a step S30 of austenitizing the high carbon steel sheet, and a step S40 of isothermally transforming the high carbon steel sheet.

First, in step S10 of preparing a high carbon steel sheet, there is prepared a high carbon steel sheet including 0.2 to 1.0 wt % carbon (C), 0 to 3.0 wt % silicon (Si), 0 to 3.0 wt % manganese (Mn), 0 to 3.0 wt % chromium (Cr), 0 to 3.0 wt % nickel (Ni), 0 to 0.5 wt % molybdenum (Mo), 0 to 3.0 wt % aluminum (Al), 0 to 0.01 wt % boron (B), 0 to 0.5 wt % titanium (Ti), and the remainder substantially being iron (Fe) and inevitable impurities.

Reasons why the contents of the high carbon steel sheet are restricted by the above-stated ranges are as follows. Hereinafter, wt % represents percentage by weight, and vol % represents percentage by volume.

First, the amount of carbon (C) may be from 0.2 wt % to 1.0 wt %. If the amount of carbon is less than 0.2 wt %, it is difficult to obtain a required strength, and no sufficient residual austenite phase required for obtaining a high elongation is formed. Further, if the amount of carbon is more than 1.0 wt %, the transformation speed of the high carbon steel sheet slows, and proeutectoid cementite may be formed.

Next, all of Mn, Cr, and Ni help to form a residual austenite phase, but slow the transformation into a bainite phase. Here, the content of Mn, the content of Cr, and the content of Ni are each less than 3.0 wt %. If the content of Mn, the content of Cr, and the content of Ni are each greater than 3.0 wt %, the phase transformation speed into bainite may be significantly reduced.

Further, a residual austenite phase whose volume percentage is greater than 15 vol % can be formed by controlling the contents of C, Mn, Cr, and Ni. For this purpose, the content ranges of C, Mn, Cr, and Ni are adjusted to satisfy the following Equation 1.

$$(3.0-2.5\times C)\text{wt }\% \leqq (Mn+Cr+Ni/2) \leqq 8.5\text{ wt }\% \qquad \text{(Equation 1)}$$

Here, if the amount of Mn+Cr+Ni/2 is less than (3.0−2.5× C) wt %, the stability of the residual austenite phase is insufficient, making it difficult to form a sufficient desired percentage and lowering strength thereof. Further, if the amount of Mn+Cr+Ni/2 is more than 8.5 wt %, the transformation into a bainite phase becomes too slow.

Meanwhile, the amount of molybdenum (Mo) is adjusted to 0.5 wt % or less. Molybdenum suppresses the formation of pearlite and prevents temper embrittlement caused by phosphorous (P). If the added amount of molybdenum is small, a pearlite phase may be formed in a cooling process and a constant temperature maintenance process. Further, temper embrittlement may occur. On the other hand, if the amount of molybdenum is more than 0.5 wt %, the brittleness of the steel increases in a rolling process.

Next, the amount of silicon (Si) is adjusted to 3.0 wt % or less. Silicon, along with aluminum, inhibits the precipitation of cementite upon bainite transformation. If the sum of silicon and aluminum is less than 1.0 wt %, too much cementite is precipitated and a mixed fine structure of bainite and residual austenite cannot be obtained. If silicon is added in an amount of more than 3.0 wt %, there are unwanted side effects including a remarkable decrease in impact properties. Accordingly, the added amount of silicon is limited to a maximum of 3.0 wt %.

The amount of aluminum (Al) is adjusted to 3.0 wt % or less. Aluminum, along with silicon, inhibits the precipitation of cementite upon bainite transformation. If the sum of silicon and aluminum is less than 1.0 wt %, too much cementite is precipitated and a mixed fine structure of bainite and residual austenite cannot be obtained. Meanwhile, aluminum (Al) makes the transformation speed of bainite faster so that a sufficient bainite transformation speed can be obtained even when the content of carbon is high. If aluminum is added in an amount of more than 3.0 wt %, castability may be deteriorated. Accordingly, the added amount of aluminum is limited to a maximum of 3.0 wt %.

That is, if the sum of silicon and aluminum is less than 1.0 wt %, too much cementite is precipitated and a mixed fine structure of bainite and residual austenite cannot be obtained. Therefore, the content range of silicon and aluminum is adjusted to satisfy the following Equation 2.

$$Si+Al \geqq 1.0 \text{ wt \%} \quad \text{(Equation 2)}$$

The amount of boron (B) is adjusted to 0.01 wt % or less. Boron (B) suppresses the formation of a pearlite phase or ferrite phase during cooling and constant temperature maintenance. If there is molybdenum or chromium in the alloy composition, and hence the formation of a pearlite phase or ferrite phase can be sufficiently suppressed, there is no need to add boron (B). If the added amount of boron is too low, a boron addition effect is insignificant. If the added amount of boron is too high, nucleation of ferrite or pearlite is facilitated and hardenability may deteriorate. Accordingly, the amount of boron is adjusted to less than 0.01 wt %, i.e., less than 100 ppm.

The amount of titanium (Ti) is adjusted to less than 0.5 wt %. If the amount of titanium is more than 0.5 wt %, castability is deteriorated. In the case of suppressing formation of a pearlite phase during cooling and constant temperature maintenance, titanium (Ti) firstly reacts with nitrogen of the steel to form TiC or TiN, thereby increasing the boron addition effect. In this case, the amount of titanium Ti is enough if it satisfies the following Equation 5, which relates the stoichiometry of titanium Ti and nitrogen (N) in steel.

$$Ti(\text{wt \%}) > N(\text{wt \%}) \times 3.42 \quad \text{(Equation 5)}$$

0.5 wt % titanium (Ti) is a much larger amount than required for the protection of boron (B). However, if this amount titanium Ti is added, it makes the bainite transformation speed faster, and the effects of the refinement of austenite crystal grains and precipitation hardening can be used together.

Here, if the high carbon steel sheet is used as an automobile part or a heat treatment part that requires high strength and a high elongation percentage, its tensile strength should be 1000-2000 MPa and its elongation percentage should be 10-40%. When such strength and elongation percentage are obtained, the steel sheet is appropriate for the aforementioned purposes. In the case of using the high carbon steel sheet for such a type of steel, it is preferable that the content of carbon in the above-explained composition is controlled to 0.4 wt % to 1.0 wt %, and the contents of manganese, chromium, and nickel are adjusted to satisfy the following Equation 6.

$$1.5 \text{ wt \%} \leqq (Mn+Cr+Ni/2) \leqq 8.5 \text{ wt \%} \quad \text{(Equation 6)}$$

Further, if the high carbon steel sheet is used for a boom, an arm or truck frame made of high strength structural material, its tensile strength should be 1000-1500 MPa and its elongation percentage should be 10-20%. When such strength and elongation percentage are obtained, the steel sheet is appropriate for the aforementioned purposes. In the case of using the high carbon steel sheet for such a type of steel, it is preferable that carbon in the above-explained composition is controlled to 0.2 wt % to 0.7 wt %, and the contents of manganese, chromium, and nickel are adjusted to satisfy the following Equation 7.

$$3.0 \text{ wt \%} \leqq (Mn+Cr+Ni/2) \leqq 8.5 \text{ wt \%} \quad \text{(Equation 7)}$$

The other components of the high carbon steel sheet, excluding the aforementioned elements, include iron (Fe) and inevitable impurities. As described above, a high carbon steel sheet including the above content ranges of elements is prepared in step S10.

Next, in step S20, the high carbon steel sheet is heated and rolled to a required thickness. In the step of hot rolling the high carbon steel sheet, a slab is re-heated by a conventional method and hot-rolled. In the hot rolling, final rolling is performed at a temperature greater than an Ar3 transformation point. The final rolling temperature of the hot rolling is set higher than the Ar3 transformation point so as to prevent rolling from occurring in a two-phase region of austenite and ferrite. If the final rolling of the hot rolling is performed in the two-phase region below the Ar3 transformation point, a large amount of proeutectoid ferrite is generated and the fine structure, strength, and elongation percentage that the present invention aims to achieve cannot be ensured.

The above description concerns the case where the high carbon steel sheet is manufactured by a hot rolling process and the final rolling in the hot rolling process is finished above the Ar3 transformation point to uniformly austenitize the structure of the steel sheet (step S30 of FIG. 1).

However, the present invention is not limited to formation in the hot-rolling process, and may be applied to a case where a steel sheet is manufactured by a typical hot rolling and cold rolling process, processed in component form, and the processed components are finally heat-treated. When the components processed in this way are finally heat-treated, first, a component manufactured from a high carbon steel sheet is prepared (step S10 of FIG. 1). Then, as shown in FIG. 2, the processed component is heated at a temperature greater than Ac3 (step S20 of FIG. 1). Finally, its structure is uniformly austenitized (step S30 of FIG. 1).

In this manner, in step S30 of FIG. 1, the structure of the steel sheet being rolled may be austenitized by a typical hot rolling process, or the structure of the processed component may be austenitized by re-heating the manufactured processed component.

Next, after the steel sheet or processed component is austenitized in this manner, it is cooled to prepare for isothermal transformation in step S40 of FIG. 1.

The hot-rolled steel sheet or processed component having a uniform austenite structure by hot final rolling or heating is cooled down to a temperature between a bainite transformation starting temperature Bs, which is a starting temperature of isothermal transformation, and a martensite transformation starting temperature Ms.

At this time, the cooling of the hot rolled steel sheet is carried out on a run-out table, and the cooling of the processed component is performed in accordance with a typical heat treatment method. Preferably, the cooling speed is 10-50° C./sec. In the case of the composition steel of the present invention, even if cooling is performed at such a cooling speed, no ferrite or pearlite transformation occurs during cooling, and an austenite phase is maintained until the temperature becomes lower than the bainite transformation starting point Bs.

After cooling is performed as above, in step S40 of FIG. 1, the high carbon steel sheet or processed component cooled in an austenite state is isothermally transformed. That is to say, as shown in FIG. 2, isothermal transformation is performed on the high carbon steel sheet at a temperature above the bainite transformation temperature Bs and the martensite transformation temperature.

Here, the isothermal transformation temperature is preferably between the bainite transformation temperature Bs and Bs−150° C. If higher than Bs, no bainite transformation can be achieved, and if lower than Bs−150° C., the amount of residual austenite decreases, thereby making it difficult to obtain an elongation percentage of more than 10%, and the transformation speed decreases, thereby making the 50% transformation time more than 48 hours.

In the case of a hot rolled steel sheet, isothermal transformation may be performed in the process of cooling a hot rolled steel sheet at a temperature between the bainite transformation starting temperature Bs and Bs−150° C., coiling it, and cooling it down to the ambient temperature.

In this way, if a hot rolled steel sheet is coiled and undergoes isothermal transformation, the isothermal transformation effect can be achieved for a maximum of 48 hours, and preferably 3 hours, by a heat retention effect inside the coil, and if Equation 3 of the present invention is satisfied, mass production using a hot rolling process is enabled.

A minimum isothermal heat treatment time required for such a high carbon steel sheet is related to the transformation speed of the high carbon steel sheet into a bainite phase. That is, it is necessary to induce a bainite transformation in order for it to be sufficiently performed. However, if the constant temperature maintenance time is too long, the residual austenite phase may be decomposed into ferrite and cementite phases so that elongation percentage may decrease. Accordingly, the isothermal transformation time is preferably one minute to 48 hours, and more preferably one minute to three hours. If the isothermal transformation time is less than one minute, transformation into bainite does not occur easily on the high carbon steel sheet. If the isothermal transformation time of the high carbon steel sheet is more than 48 hours, the amount of residual austenite of the high carbon steel sheet decreases.

Meanwhile, if the bainite transformation of the high carbon steel sheet is finished at greater than 50 vol % and less than 100 vol %, target strength and ductility can be obtained. Accordingly, economic efficiency can be achieved by reducing the manufacturing time of the high carbon steel sheet, and the time taken to complete 50 vol % bainite transformation of the high carbon steel sheet is related to heat treatment temperature and alloy components as shown in the following Equation 3.

$$\text{Log } 10[50\% \text{ transformation time(sec)}] = -2.742 + 3.561\times C + 0.820\times Mn + 0.416\times Cr + 0.402\times Ni - 0.332\times Al + 1330/T + 273 \leqq \text{Log } 10[3\times 3600] \quad \text{(Equation 3)}$$

Here, the units of the content of each element are wt %, and T is transformation temperature in degrees Celsius. Further, the 50% transformation time (sec) represents the minimum time required for 50% of the steel to be transformed into bainite.

The above-described Equation 3 means that the bainite transformation speed can be adjusted by adjusting the alloy components. Accordingly, a desired transformation speed can be obtained by adjusting the alloy components at a specific cooling temperature or at a specific isothermal transformation temperature.

In the above Equation 3, if the 50% transformation time (sec) is set to three hours, the following Equation 8 is obtained.

$$-2.742 + 3.561\times C + 0.820\times Mn + 0.416\times Cr + 0.402\times Ni - 0.332\times Al + 1330/T + 273 \leqq 4.03 \quad \text{(Equation 8)}$$

If the components of the elements included in the high carbon steel sheet satisfy the aforementioned Equation 8, more than 50% of the crystal phase of the steel sheet is transformed into bainite within three hours. By adjusting the content ranges of the high carbon steel sheet and the bainite transformation temperature using Equation 3 and Equation 8, fast bainite transformation occurs.

Here, the bainite transformation temperature is related to the content ranges of the high carbon steel sheet as shown in the following Equation 4.

$$\text{bainite transformation temperature}(Bs)(^\circ\text{ C.}) = 830 - 270\times C - 90\times Mn - 37\times Ni - 70\times Cr - 83\times Mo \quad \text{(Equation 4)}$$

Here, the units of the content of each element are wt %. In the exemplary embodiment of the present invention, the bainite transformation temperature is set by adjusting the amount of carbon and the amounts of Mn, Ni, and Mo. Accordingly, the isothermal transformation temperature can be optimized by using the bainite transformation temperature set appropriately for the composition of the high carbon steel sheet. Therefore, even if the content ranges of the high carbon steel sheet change, the desired fine structure of the high carbon steel sheet can be efficiently obtained within a short time by adjusting the isothermal transformation time and the isothermal transformation temperature.

Figure 2:
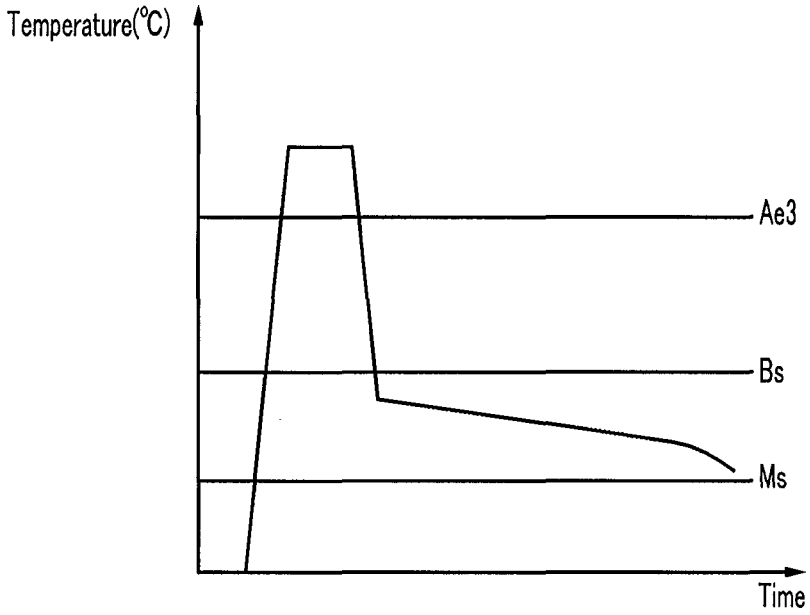
FIG. 2 is a graph showing a temperature change according to the method for manufacturing a high carbon steel sheet according to one exemplary embodiment of the present invention.

As shown in FIG. 2, while the temperature of the high carbon steel sheet is maintained nearly constant for a long period of time, part of the austenite phase is transformed into bainite. Accordingly, the high carbon steel sheet after isothermal transformation has a fine mixed structure of bainite and residual austenite.

In the exemplary embodiment of the present invention, as the bainite transformation is performed rapidly, 50 vol % to 85 vol % of the entire phase is transformed into bainite, and 15 vol % to 50 vol % of the entire phase is remained as residual austenite, during 180 minutes of isothermal transformation. Accordingly, in spite of the isothermal transformation over a short time, a fine structure with an ideal mixture of residual austenite and bainite is provided.

If the volume percentage of bainite is less than 50 vol %, the carbon concentrated volume in the residual austenite is too low and martensite is generated, thereby degrading elongation percentage. Further, if the volume percentage of bainite is more than 85 vol %, the amount of residual austenite is too low, thereby decreasing the elongation percentage of the high carbon steel sheet. In addition, if the amount of austenite is less than 15 vol %, the amount of austenite is too low, thereby decreasing the elongation of the high carbon steel sheet. Further, if the amount of austenite is more than 50 vol %, the carbon concentration in the residual austenite is too low and hence martensite is generated, thereby degrading the elongation percentage.

Figure 3:
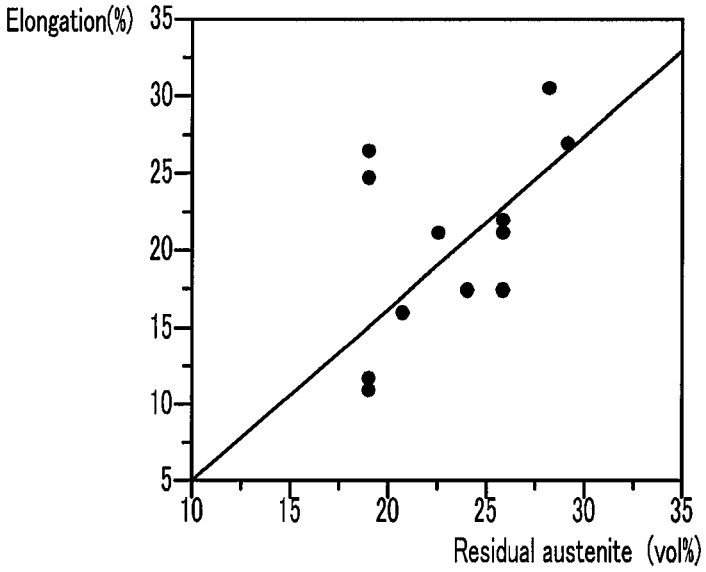
FIG. 3 is a graph showing the relationship between ratio of residual austenite and elongation percentage of the high carbon steel sheet according to one exemplary embodiment of the present invention.

FIG. 3 is a graph showing the relationship between ratio of residual austenite and elongation percentage of the high carbon steel sheet according to one exemplary embodiment of the present invention.

As shown in FIG. 3, the elongation percentage according to the ratio of residual austenite of the high carbon steel sheet is represented as circular points. It can be seen that the larger the volume percentage of residual austenite, the larger the elongation percentage.

FIG. 3 shows the volume percentage and elongation percentage of residual austenite linearized by a least squares method. As shown in FIG. 3, a straight line passing through the original point and having a slope of 0.86894 is obtained. Accordingly, if the residual austenite exceeds 11.6 vol % of the high carbon steel sheet, the elongation percentage of the high carbon steel sheet becomes more than 10%. Accordingly, even considering error, if the residual austenite is more than 15 vol %, a high carbon steel sheet having an elongation percentage of more than 10% can be obtained.

Accordingly, the high carbon steel sheet manufactured by the above method has a tensile strength of more than 1000 MPa and an elongation percentage of more than 10%. Thus, since a high carbon steel sheet having superior strength and elongation percentage can be manufactured, it is appropriate for use in automobile parts or the like.

Hereinafter, the present invention will be described in more detail through experimental examples. Such experimental examples are merely for illustration of the present invention, and the present invention is not limited thereto.

EXPERIMENTAL EXAMPLE

As shown in the following Table 1, an experiment was performed using high carbon steel sheets of 26 types from A to Z. The contents of each high carbon steel sheet are represented in the following Table 1. The compositions of the high carbon steel sheets all satisfied the content ranges of the present invention.

However, even when the components satisfied the content ranges of the present invention, if bainite transformation was not performed at a temperature between Bs−150 and Bs, the elongation percentage was less than 10%. These cases were all represented by comparative examples. Further, the results of evaluation of the properties of AA to AC steels that are beyond the content ranges of the present invention are represented by a comparative example, and the alloy components of the AA to AC steels are all shown in Table 1.

TABLE 1

| Type of Steel | C | Si | Mn | Ni | Cr | Mo | Al | Ti | B | Fe and impurities |
|---|---|---|---|---|---|---|---|---|---|---|
| A | 0.807 | 1.50 | 1.99 | 0.001 | 1.00 | 0.252 | 2.00 | 0.0001 | 0.0001 | Remainder |
| B | 0.800 | 1.70 | 1.51 | 0.001 | 2.00 | 0.261 | 2.20 | 0.0001 | 0.0001 | |
| C | 0.837 | 1.47 | 1.50 | 0.001 | 0.001 | 0.001 | 2.00 | 0.0001 | 0.0001 | |
| D | 0.592 | 1.48 | 1.97 | 0.001 | 0.99 | 0.250 | 0.98 | 0.0001 | 0.0001 | |
| E | 0.610 | 1.49 | 1.99 | 2.02 | 1.23 | 0.250 | 2.55 | 0.0001 | 0.0001 | |
| F | 0.605 | 1.50 | 1.99 | 0.001 | 2.18 | 0.250 | 2.01 | 0.0001 | 0.0001 | |
| G | 0.609 | 1.44 | 2.01 | 0.001 | 1.00 | 0.001 | 1.00 | 0.0001 | 0.0001 | |
| H | 0.648 | 1.49 | 2.05 | 0.001 | 0.989 | 0.001 | 1.99 | 0.0001 | 0.0001 | |
| I | 0.600 | 1.53 | 2.00 | 0.001 | 1.00 | 0.001 | 1.02 | 0.05 | 0.0020 | |
| J | 0.605 | 2.59 | 2.00 | 0.001 | 0.990 | 0.001 | 1.03 | 0.0001 | 0.0001 | |
| K | 0.394 | 1.49 | 2.00 | 0.001 | 1.01 | 0.247 | 1.00 | 0.0001 | 0.0001 | |
| L | 0.409 | 1.50 | 2.56 | 0.001 | 2.40 | 0.001 | 1.00 | 0.29 | 0.0022 | |
| M | 0.594 | 1.52 | 1.51 | 0.001 | 0.001 | 0.001 | 1.00 | 0.0001 | 0.0001 | |
| N | 0.665 | 1.49 | 1.50 | 0.001 | 0.001 | 0.001 | 1.90 | 0.0001 | 0.0001 | |
| O | 0.212 | 1.43 | 2.52 | 1.01 | 1.00 | 0.255 | 0.001 | 0.0001 | 0.0001 | |
| P | 0.298 | 1.5 | 2.59 | 0.001 | 1.02 | 0.001 | 1.00 | 0.027 | 0.0025 | |
| Q | 0.3 | 1.53 | 2.6 | 1.00 | 0.98 | 0.251 | 0.98 | 0.0001 | 0.0001 | |
| R | 0.311 | 1.49 | 2.55 | 0.99 | 0.99 | 0.255 | 0.001 | 0.0001 | 0.0001 | |
| S | 0.304 | 1.5 | 1.99 | 1.00 | 0.99 | 0.55 | 1.00 | 0.0001 | 0.0001 | |
| T | 0.299 | 1.5 | 2.49 | 0.001 | 1.47 | 0.252 | 1.02 | 0.0001 | 0.0001 | |
| U | 0.43 | 2.47 | 2.01 | 0.001 | 1.01 | 0.26 | 1.01 | 0.0001 | 0.0001 | |
| V | 0.401 | 1.58 | 2 | 0.001 | 0.99 | 0.001 | 1 | 0.030 | 0.0029 | |
| W | 0.267 | 0.94 | 1.92 | 0.97 | 0.001 | 0.248 | 1.61 | 0.0001 | 0.0001 | |
| X | 0.298 | 1.02 | 2.13 | 1.13 | 1.03 | 0.001 | 2.08 | 0.028 | 0.0027 | |
| Y | 0.300 | 0.511 | 2.03 | 1.02 | 0.001 | 0.251 | 1.60 | 0.0001 | 0.0001 | |
| Z | 0.606 | 1.48 | 2.99 | 0.001 | 1.20 | 0.253 | 0.047 | 0.0001 | 0.0001 | |
| AA | 0.153 | 1.00 | 2.04 | 0.001 | 0.001 | 0.001 | 2.10 | 0.033 | 0.0030 | |
| AB | 0.25 | 1.01 | 1.51 | 0.001 | 0.001 | 0.249 | 2.09 | 0.0001 | 0.0001 | |
| AC | 0.40 | 0.51 | 1.99 | 0.001 | 0.001 | 0.001 | 0.30 | 0.0001 | 0.0001 | |

In the experiment, firstly, a high carbon sheet was manufactured with a thickness of 30 mm and a width of 200 m and then re-heated for 180 minutes at 1200° C. Next, the high carbon steel sheet was hot-rolled such that its thickness was 3.0 mm. The high carbon steel sheet obtained by the aforementioned method was austenitized for about 30 minutes within a temperature range of 900° C.-1100° C. according to its components, so that most of the structure was transformed into austenite, and was then cooled down to a target temperature to thus carry out isothermal transformation heat treatment. Subsequent processing was carried out as Experimental Examples 1 to 38 and Comparative Examples 1 to 10 described below, and the strength and ductility of the high carbon steel sheet according to the experiment were measured. The constant temperature heat treatment time of the high carbon steel sheet was set to a time for which the bainite transformation could be sufficiently performed to more than 50 vol %.

Experimental Example 1

An A-type high carbon steel sheet underwent isothermal transformation heat treatment in a 300° C. salt bath. That is, a high carbon steel sheet underwent isothermal transformation heat treatment starting from 42° C. below the transformation starting temperature (342° C.). The time taken for the bainite transformation to be performed to 50 vol % was measured using a dilatometer. As a result, the time taken for the bainite transformation to reach 50 vol % was 1.8 hours. As a result of heat treatment of the high carbon steel sheet for six hours, the tensile strength was 1464 MPa and the elongation percentage was 11.8%.

Experimental Example 2

An A-type high carbon steel sheet underwent isothermal transformation heat treatment in a 340° C. salt bath. That is, a high carbon steel sheet underwent isothermal transformation heat treatment starting from 2° C. below the transformation starting temperature (342° C.). The time taken for the bainite transformation to reach 50 vol % was measured using a dilatometer. As a result, the time taken for the bainite transformation to reach 50 vol % was 1.2 hours. As a result of heat treatment of the high carbon steel sheet for six hours, the tensile strength was 1375 MPa and the elongation percentage was 20.1%.

Experimental Example 3

A γ-type high carbon steel sheet underwent isothermal transformation heat treatment in a 250° C. salt bath. That is, a high carbon steel sheet underwent isothermal transformation heat treatment starting from 66° C. below the transformation starting temperature (316° C.). The time taken for the bainite transformation to reach 50 vol % was measured using a dilatometer. As a result, the time taken for the bainite transformation to reach 50 vol % was 2.8 hours. As a result of heat treatment of the high carbon steel sheet for 12 hours, the tensile strength was 1506 MPa and the elongation percentage was 25.9%.

Experimental Example 4

A C-type high carbon steel sheet underwent isothermal transformation heat treatment in a 350° C. salt bath. That is, a high carbon steel sheet underwent isothermal transformation heat treatment starting from 119° C. below the transformation starting temperature (469° C.). The time taken for the bainite transformation to reach 50 vol % was measured using a dilatometer. As a result, the time taken for the bainite transformation to reach 50 vol % was 0.2 hours. As a result of heat treatment of the high carbon steel sheet for three hours, the tensile strength was 1258 MPa and the elongation percentage was 15.1%.

Experimental Example 5

A C-type high carbon steel sheet underwent isothermal transformation heat treatment in a 400° C. salt bath. That is, a high carbon steel sheet underwent isothermal transformation heat treatment starting from 69° C. below the transformation starting temperature (469° C.). The time taken for the bainite transformation to reach 50 vol % was measured using a dilatometer. As a result, the time taken for the bainite transformation to reach 50 vol % was 0.1 hours. As a result of heat treatment of the high carbon steel sheet for three hours, the tensile strength was 1119 MPa and the elongation percentage was 35.7%.

Experimental Example 6

A D-type high carbon steel sheet underwent isothermal transformation heat treatment in a 300° C. salt bath. That is, a high carbon steel sheet underwent isothermal transformation heat treatment starting from 103° C. below the transformation starting temperature (403° C.). The time taken for the bainite transformation to reach 50 vol % was measured using a dilatometer. As a result, the time taken for the bainite transformation to reach 50 vol % was 0.7 hours. As a result of heat treatment of the high carbon steel sheet for three hours, the tensile strength was 1383 MPa and the elongation percentage was 10.7%.

Experimental Example 7

A D-type high carbon steel sheet underwent isothermal transformation heat treatment in a 350° C. salt bath. That is, a high carbon steel sheet underwent isothermal transformation heat treatment starting from 53° C. below the transformation starting temperature (403° C.). The time taken for the bainite transformation to reach 50 vol % was measured using a dilatometer. As a result, the time taken for the bainite transformation to reach 50 vol % was 0.4 hours. As a result of heat treatment of the high carbon steel sheet for three hours, the tensile strength was 1331 MPa and the elongation percentage was 31.8%.

Experimental Example 8

An E-type high carbon steel sheet underwent isothermal transformation heat treatment in a 280° C. salt bath. That is, a high carbon steel sheet underwent isothermal transformation heat treatment starting from 25° C. below the transformation starting temperature (305° C.). The time taken for the bainite transformation to reach 50 vol % was measured using a dilatometer. As a result, the time taken for the bainite transformation to reach 50 vol % was 3.0 hours. As a result of heat treatment of the high carbon steel sheet for 12 hours, the tensile strength was 1553 MPa and the elongation percentage was 26.2%.

Experimental Example 9

An E-type high carbon steel sheet underwent isothermal transformation heat treatment in a 300° C. salt bath. That is, a high carbon steel sheet underwent isothermal transformation heat treatment starting from 5° C. below the transformation starting temperature (305° C.). The time taken for the bainite transformation to reach 50 vol % was measured using a dilatometer. As a result, the time taken for the bainite transformation to reach 50 vol % was 2.4 hours. As a result of heat treatment of the high carbon steel sheet for 12 hours, the tensile strength was 1677 MPa and the elongation percentage was 21.5%.

Experimental Example 10

An F-type high carbon steel sheet underwent isothermal transformation heat treatment in a 250° C. salt bath. That is, a high carbon steel sheet underwent isothermal transformation heat treatment starting from 64° C. below the transformation starting temperature (314° C.). The time taken for the bainite transformation to reach 50 vol % was measured using a dilatometer. As a result, the time taken for the bainite transformation to reach 50 vol % was 2.0 hours. As a result of heat treatment of the high carbon steel sheet for 12 hours, the tensile strength was 1812 MPa and the elongation percentage was 15.9%.

Experimental Example 11

An F-type high carbon steel sheet underwent isothermal transformation heat treatment in a 280° C. salt bath. That is, a high carbon steel sheet underwent isothermal transformation heat treatment starting from 64° C. below the transformation starting temperature (314° C.). The time taken for the bainite transformation to reach 50 vol % was measured using a dilatometer. As a result, the time taken for the bainite transformation to reach 50 vol % was 2.0 hours. As a result of heat treatment of the high carbon steel sheet for six hours, the tensile strength was 1635 MPa and the elongation percentage was 20.1%.

Experimental Example 12

An F-type high carbon steel sheet underwent isothermal transformation heat treatment in a 300° C. salt bath. That is, a high carbon steel sheet underwent isothermal transformation heat treatment starting from 14° C. below the transformation starting temperature (314° C.). The time taken for the bainite transformation to reach 50 vol % was measured using a dilatometer. As a result, the time taken for the bainite transformation to reach 50 vol % was 1.1 hours. As a result of heat treatment of the high carbon steel sheet for three hours, the tensile strength was 1598 MPa and the elongation percentage was 26.7%.

Experimental Example 13

A G-type high carbon steel sheet underwent isothermal transformation heat treatment in a 300° C. salt bath. That is, a high carbon steel sheet underwent isothermal transformation heat treatment starting from 115° C. below the transformation starting temperature (415° C.). The time taken for the bainite transformation to reach 50 vol % was measured using a dilatometer. As a result, the time taken for the bainite transformation to reach 50 vol % was 0.9 hours. As a result of heat treatment of the high carbon steel sheet for three hours, the tensile strength was 1504 MPa and the elongation percentage was 12.1%.

Experimental Example 14

A G-type high carbon steel sheet underwent isothermal transformation heat treatment in a 350° C. salt bath. That is, a high carbon steel sheet underwent isothermal transformation heat treatment starting from 65° C. below the transformation starting temperature (415° C.). The time taken for the bainite transformation to reach 50 vol % was measured using a dilatometer. As a result, the time taken for the bainite transformation to reach 50 vol % was 0.5 hours. As a result of heat treatment of the high carbon steel sheet for three hours, the tensile strength was 1343 MPa and the elongation percentage was 22.2%.

Experimental Example 15

An H-type high carbon steel sheet underwent isothermal transformation heat treatment in a 300° C. salt bath. That is, a high carbon steel sheet underwent isothermal transformation heat treatment starting from 101° C. below the transformation starting temperature (401° C.). The time taken for the bainite transformation to reach 50 vol % was measured using a dilatometer. As a result, the time taken for the bainite transformation to reach 50 vol % was 0.6 hours. As a result of heat treatment of the high carbon steel sheet for three hours, the tensile strength was 1415 MPa and the elongation percentage was 13.1%.

Experimental Example 16

An I-type high carbon steel sheet underwent isothermal transformation heat treatment in a 350° C. salt bath. That is, a high carbon steel sheet underwent isothermal transformation heat treatment starting from 68° C. below the transformation starting temperature (418° C.). The time taken for the bainite transformation to reach 50 vol % was measured using a dilatometer. As a result, the time taken for the bainite transformation to reach 50 vol % was 0.5 hours. As a result of heat treatment of the high carbon steel sheet for three hours, the tensile strength was 1452 MPa and the elongation percentage was 21.4%.

Experimental Example 17

A J-type high carbon steel sheet underwent isothermal transformation heat treatment in a 300° C. salt bath. That is, a high carbon steel sheet underwent isothermal transformation heat treatment starting from 117° C. below the transformation starting temperature (417° C.). The time taken for the bainite transformation to reach 50 vol % was measured using a dilatometer. As a result, the time taken for the bainite transformation to reach 50 vol % was 0.8 hours. As a result of heat treatment of the high carbon steel sheet for three hours, the tensile strength was 1491 MPa and the elongation percentage was 18.1%.

Experimental Example 18

A J-type high carbon steel sheet underwent isothermal transformation heat treatment in a 350° C. salt bath. That is, a high carbon steel sheet underwent isothermal transformation heat treatment starting from 67° C. below the transformation starting temperature (417° C.). The time taken for the bainite transformation to reach 50 vol % was measured using a dilatometer. As a result, the time taken for the bainite transformation to reach 50 vol % was 0.5 hours. As a result of heat treatment of the high carbon steel sheet for three hours, the tensile strength was 1497 MPa and the elongation percentage was 27.2%.

Experimental Example 19

A K-type high carbon steel sheet underwent isothermal transformation heat treatment in a 350° C. salt bath. That is, a high carbon steel sheet underwent isothermal transformation heat treatment starting from 102° C. below the transformation starting temperature (452° C.). The time taken for the bainite transformation to reach 50 vol % was measured using a dilatometer. As a result, the time taken for the bainite transformation to reach 50 vol % was 0.5 hours. As a result of heat treatment of the high carbon steel sheet for three hours, the tensile strength was 1333 MPa and the elongation percentage was 14.6%.

Experimental Example 20

A K-type high carbon steel sheet underwent isothermal transformation heat treatment in a 400° C. salt bath. That is, a high carbon steel sheet underwent isothermal transformation heat treatment starting from 52° C. below the transformation starting temperature (452° C.). The time taken for the bainite transformation to reach 50 vol % was measured using a dilatometer. As a result, the time taken for the bainite transformation to reach 50 vol % was 0.1 hours. As a result of heat treatment of the high carbon steel sheet for three hours, the tensile strength was 1365 MPa and the elongation percentage was 20.3%.

Experimental Example 21

An L-type high carbon steel sheet underwent isothermal transformation heat treatment in a 300° C. salt bath. That is, a high carbon steel sheet underwent isothermal transformation heat treatment starting from 21° C. below the transformation starting temperature (321° C.). The time taken for the bainite transformation to reach 50 vol % was measured using a dilatometer. As a result, the time taken for the bainite transformation to reach 50 vol % was 1.8 hours. As a result of heat treatment of the high carbon steel sheet for six hours, the tensile strength was 1591 MPa and the elongation percentage was 15.4%.

Experimental Example 22

An M-type high carbon steel sheet underwent isothermal transformation heat treatment in a 400° C. salt bath. That is, a high carbon steel sheet underwent isothermal transformation heat treatment starting from 134° C. below the transformation starting temperature (534° C.). The time taken for the bainite transformation to reach 50 vol % was measured using a dilatometer. As a result, the time taken for the bainite transformation to reach 50 vol % was 0.1 hours. As a result of heat treatment of the high carbon steel sheet for three hours, the tensile strength was 1170 MPa and the elongation percentage was 11.0%.

Experimental Example 23

An N-type high carbon steel sheet underwent isothermal transformation heat treatment in a 400° C. salt bath. That is, a high carbon steel sheet underwent isothermal transformation heat treatment starting from 115° C. below the transformation starting temperature (515° C.). The time taken for the bainite transformation to reach 50 vol % was measured using a dilatometer. As a result, the time taken for the bainite transformation to reach 50 vol % was 0.04 hours. As a result of heat treatment of the high carbon steel sheet for three hours, the tensile strength was 1057 MPa and the elongation percentage was 27.6%.

Experimental Example 24

An O-type high carbon steel sheet underwent isothermal transformation heat treatment in a 350° C. salt bath. That is, a high carbon steel sheet underwent isothermal transformation heat treatment starting from 67° C. below the transformation starting temperature (417° C.). The time taken for the bainite transformation to reach 50 vol % was measured using a dilatometer. As a result, the time taken for the bainite transformation to reach 50 vol % was 0.3 hours. As a result of heat treatment of the high carbon steel sheet for three hours, the tensile strength was 1354 MPa and the elongation percentage was 13.0%.

Experimental Example 25

A P-type high carbon steel sheet underwent isothermal transformation heat treatment in a 300° C. salt bath. That is, a high carbon steel sheet underwent isothermal transformation heat treatment starting from 145° C. below the transformation starting temperature (445° C.). The time taken for the bainite transformation to reach 50 vol % was measured using a dilatometer. As a result, the time taken for the bainite transformation to reach 50 vol % was 0.2 hours. As a result of heat treatment of the high carbon steel sheet for three hours, the tensile strength was 1378 MPa and the elongation percentage was 12.2%.

Experimental Example 26

A P-type high carbon steel sheet underwent isothermal transformation heat treatment in a 350° C. salt bath. That is, a high carbon steel sheet underwent isothermal transformation heat treatment starting from 95° C. below the transformation starting temperature (445° C.). The time taken for the bainite transformation to reach 50 vol % was measured using a dilatometer. As a result, the time taken for the bainite transformation to reach 50 vol % was 0.1 hours. As a result of heat treatment of the high carbon steel sheet for three hours, the tensile strength was 1343 MPa and the elongation percentage was 13.8%.

Experimental Example 27

A Q-type high carbon steel sheet underwent isothermal transformation heat treatment in a 300° C. salt bath. That is, a high carbon steel sheet underwent isothermal transformation heat treatment starting from 89° C. below the transformation starting temperature (389° C.). The time taken for the bainite transformation to reach 50 vol % was measured using a dilatometer. As a result, the time taken for the bainite transformation to reach 50 vol % was 0.3 hours. As a result of heat treatment of the high carbon steel sheet for three hours, the tensile strength was 1343 MPa and the elongation percentage was 13.8%.

Experimental Example 28

A Q-type high carbon steel sheet underwent isothermal transformation heat treatment in a 350° C. salt bath. That is, a high carbon steel sheet underwent isothermal transformation heat treatment starting from 39° C. below the transformation starting temperature (389° C.). The time taken for the bainite transformation to reach 50 vol % was measured using a dilatometer. As a result, the time taken for the bainite transformation to reach 50 vol % was 0.3 hours. As a result of heat treatment of the high carbon steel sheet for three hours, the tensile strength was 1388 MPa and the elongation percentage was 14.4%.

Experimental Example 29

An R-type high carbon steel sheet underwent isothermal transformation heat treatment in a 300° C. salt bath. That is, a high carbon steel sheet underwent isothermal transformation heat treatment starting from 89° C. below the transformation starting temperature (389° C.). The time taken for the bainite transformation to reach 50 vol % was measured using a dilatometer. As a result, the time taken for the bainite transformation to reach 50 vol % was 1.1 hours. As a result of heat treatment of the high carbon steel sheet for three hours, the tensile strength was 1475 MPa and the elongation percentage was 11.8%.

Experimental Example 30

An S-type high carbon steel sheet underwent isothermal transformation heat treatment in a 350° C. salt bath. That is, a high carbon steel sheet underwent isothermal transformation heat treatment starting from 67° C. below the transformation starting temperature (417° C.). The time taken for the bainite transformation to reach 50 vol % was measured using a dilatometer. As a result, the time taken for the bainite transformation to reach 50 vol % was 0.1 hours. As a result of heat treatment of the high carbon steel sheet for three hours, the tensile strength was 1330 MPa and the elongation percentage was 13.8%.

Experimental Example 31

A T-type high carbon steel sheet underwent isothermal transformation heat treatment in a 350° C. salt bath. That is, a high carbon steel sheet underwent isothermal transformation heat treatment starting from 51° C. below the transformation starting temperature (401° C.). The time taken for the bainite transformation to reach 50 vol % was measured using a dilatometer. As a result, the time taken for the bainite transformation to reach 50 vol % was 0.2 hours. As a result of heat treatment of the high carbon steel sheet for three hours, the tensile strength was 1363 MPa and the elongation percentage was 15.0%.

Experimental Example 32

A U-type high carbon steel sheet underwent isothermal transformation heat treatment in a 350° C. salt bath. That is, a high carbon steel sheet underwent isothermal transformation heat treatment starting from 91° C. below the transformation starting temperature (441° C.). The time taken for the bainite transformation to reach 50 vol % was measured using a dilatometer. As a result, the time taken for the bainite transformation to reach 50 vol % was 0.1 hours. As a result of heat treatment of the high carbon steel sheet for three hours, the tensile strength was 1420 MPa and the elongation percentage was 16.1%.

Experimental Example 33

A U-type high carbon steel sheet underwent isothermal transformation heat treatment in a 350° C. salt bath. That is, a high carbon steel sheet underwent isothermal transformation heat treatment starting from 122° C. below the transformation starting temperature (472° C.). The time taken for the bainite transformation to reach 50 vol % was measured using a dilatometer. As a result, the time taken for the bainite transformation to reach 50 vol % was 0.1 hours. As a result of heat treatment of the high carbon steel sheet for three hours, the tensile strength was 1326 MPa and the elongation percentage was 14.3%.

Experimental Example 34

A W-type high carbon steel sheet underwent isothermal transformation heat treatment in a 400° C. salt bath. That is, a high carbon steel sheet underwent isothermal transformation heat treatment starting from 129° C. below the transformation starting temperature (529° C.). The time taken for the bainite transformation to reach 50 vol % was measured using a dilatometer. As a result, the time taken for the bainite transformation to reach 50 vol % was 0.02 hours. As a result of heat treatment of the high carbon steel sheet for three hours, the tensile strength was 1010 MPa and the elongation percentage was 15.5%.

Experimental Example 35

An X-type high carbon steel sheet underwent isothermal transformation heat treatment in a 370° C. salt bath. That is, a high carbon steel sheet underwent isothermal transformation heat treatment starting from 74° C. below the transformation starting temperature (444° C.). The time taken for the bainite transformation to reach 50 vol % was measured using a dilatometer. As a result, the time taken for the bainite transformation to reach 50 vol % was 0.05 hours. As a result of heat treatment of the high carbon steel sheet for three hours, the tensile strength was 1145 MPa and the elongation percentage was 14.6%.

Experimental Example 36

A Y-type high carbon steel sheet underwent isothermal transformation heat treatment in a 370° C. salt bath. That is, a high carbon steel sheet underwent isothermal transformation heat treatment starting from 138° C. below the transformation starting temperature (508° C.). The time taken for the bainite transformation to reach 50 vol % was measured using a dilatometer. As a result, the time taken for the bainite transformation to reach 50 vol % was 0.02 hours. As a result of heat treatment of the high carbon steel sheet for three hours, the tensile strength was 1195 MPa and the elongation percentage was 11.7%.

Experimental Example 37

A Z-type high carbon steel sheet underwent isothermal transformation heat treatment in a salt bath 250° C. That is, a high carbon steel sheet underwent isothermal transformation heat treatment starting from a temperature below the transformation starting temperature (292° C.) by 42° C. The time taken for the bainite transformation to reach 50 vol % was measured using a dilatometer. As a result, the time taken for the bainite transformation to reach 50 vol % was 23.4 hours. As a result of heat treatment of the high carbon steel sheet for 48 hours, the tensile strength was 1790 MPa and the elongation percentage was 17.1%.

Experimental Example 38

A Z-type high carbon steel sheet underwent isothermal transformation heat treatment in a 280° C. salt bath. That is, a high carbon steel sheet underwent isothermal transformation heat treatment starting from 12° C. below the transformation starting temperature (292° C.). The time taken for the bainite transformation to reach 50 vol % was measured using a dilatometer. As a result, the time taken for the bainite transformation to reach 50 vol % was 15.9 hours. As a result of heat treatment of the high carbon steel sheet for 48 hours, the tensile strength was 1567 MPa and the elongation percentage was 23.6%.

Comparative Example 1

A D-type high carbon steel sheet underwent isothermal transformation heat treatment in a 200° C. salt bath. That is, a high carbon steel sheet underwent isothermal transformation heat treatment starting from 203° C. below the transformation starting temperature (403° C.). The time taken for the bainite transformation to reach 50 vol % was measured using a dilatometer. As a result, the time taken for the bainite transformation to reach 50 vol % was 2.7 hours. As a result of heat treatment of the high carbon steel sheet for 24 hours, the tensile strength was 2059 MPa and the elongation percentage was 9.5%.

Comparative Example 2

A D-type high carbon steel sheet underwent isothermal transformation heat treatment in a 250° C. salt bath. That is, a high carbon steel sheet underwent isothermal transformation heat treatment starting from 153° C. below the transformation starting temperature (403° C.). The time taken for the bainite transformation to reach 50 vol % was measured using a dilatometer. As a result, the time taken for the bainite transformation to reach 50 vol % was 1.3 hours. As a result of heat treatment of the high carbon steel sheet for six hours, the tensile strength was 1748 MPa and the elongation percentage was 9.4%.

Comparative Example 3

A K-type high carbon steel sheet underwent isothermal transformation heat treatment in a 300° C. salt bath. That is, a high carbon steel sheet underwent isothermal transformation heat treatment starting from 152° C. below the transformation starting temperature (452° C.). The time taken for the bainite transformation to reach 50 vol % was measured using a dilatometer. As a result, the time taken for the bainite transformation to reach 50 vol % was 0.2 hours. As a result of heat treatment of the high carbon steel sheet for three hours, the tensile strength was 1488 MPa and the elongation percentage was 9.1%.

Comparative Example 4

An M-type high carbon steel sheet underwent isothermal transformation heat treatment in a 350° C. salt bath. That is, a high carbon steel sheet underwent isothermal transformation heat treatment starting from 184° C. below the transformation starting temperature (534° C.). The time taken for the bainite transformation to reach 50 vol % was measured using a dilatometer. As a result, the time taken for the bainite transformation to reach 50 vol % was 0.2 hours. As a result of heat treatment of the high carbon steel sheet for three hours, the tensile strength was 1279 MPa and the elongation percentage was 9.1%.

Comparative Example 5

An N-type high carbon steel sheet underwent isothermal transformation heat treatment in a 350° C. salt bath. That is, a high carbon steel sheet underwent isothermal transformation heat treatment starting from 165° C. below the transformation starting temperature (515° C.). The time taken for the bainite transformation to reach 50 vol % was measured using a dilatometer. As a result, the time taken for the bainite transformation to reach 50 vol % was 0.1 hours. As a result of heat treatment of the high carbon steel sheet for three hours, the tensile strength was 1247 MPa and the elongation percentage was 9.0%.

Comparative Example 6

An O-type high carbon steel sheet underwent isothermal transformation heat treatment in a 250° C. salt bath. That is, a high carbon steel sheet underwent isothermal transformation heat treatment starting from 167° C. below the transformation starting temperature (417° C.). The time taken for the bainite transformation to reach 50 vol % was measured using a dilatometer. As a result, the time taken for the bainite transformation to reach 50 vol % was 0.8 hours. As a result of heat treatment of the high carbon steel sheet for three hours, the tensile strength was 1412 MPa and the elongation percentage was 7.7%.

Comparative Example 7

A V-type high carbon steel sheet underwent isothermal transformation heat treatment in a 300° C. salt bath. That is, a high carbon steel sheet underwent isothermal transformation heat treatment starting from 172° C. below the transformation starting temperature (472° C.). The time taken for the bainite transformation to reach 50 vol % was measured using a dilatometer. As a result, the time taken for the bainite transformation to reach 50 vol % was 0.1 hours. As a result of heat treatment of the high carbon steel sheet for three hours, the tensile strength was 1482 MPa and the elongation percentage was 7.6%.

Comparative Example 8

An AA-type high carbon steel sheet underwent isothermal transformation heat treatment in a 460° C. salt bath. That is, a high carbon steel sheet underwent isothermal transformation heat treatment starting from 145° C. below the transformation starting temperature (605° C.). The time taken for the bainite transformation to reach 50 vol % was measured using a dilatometer. As a result, the time taken for the bainite transformation to reach 50 vol % was 0.01 hours. As a result of heat treatment of the high carbon steel sheet for three hours, the tensile strength was 717 MPa and the elongation percentage was 14.0%.

Comparative Example 9

An AB-type high carbon steel sheet underwent isothermal transformation heat treatment in a 480° C. salt bath. That is, a high carbon steel sheet underwent isothermal transformation heat treatment starting from 126° C. below the transformation starting temperature (606° C.). The time taken for the bainite transformation to reach 50 vol % was measured using a dilatometer. As a result, the time taken for the bainite transformation to reach 50 vol % was 0.01 hours. As a result of heat treatment of the high carbon steel sheet for three hours, the tensile strength was 752 MPa and the elongation percentage was 12.2%.

Comparative Example 10

An AC-type high carbon steel sheet underwent isothermal transformation heat treatment in a 450° C. salt bath. That is, a high carbon steel sheet underwent isothermal transformation heat treatment starting from 92° C. below the transformation starting temperature (542° C.). The time taken for the bainite transformation to reach 50 vol % was measured using a dilatometer. As a result, the time taken for the bainite transformation to reach 50 vol % was 0.03 hours. As a result of heat treatment of the high carbon steel sheet for three hours, the tensile strength was 1150 MPa and the elongation percentage was 8.5%.

The above Experimental Examples 1 to 38 and Comparative Examples 1 to 10 will be shown in the following table 2.

TABLE 2

| Classification | Steel type | Isothermal transformation temperature | t0.5 (hr) | Bs-T | Tensile strength | Elongation |
|---|---|---|---|---|---|---|
| Experimental Example 1 | A | 300° C. | 1.8 | 42° C. | 1464 MPa | 11.8% |
| Experimental Example 2 | A | 340° C. | 1.2 | 2° C. | 1375 MPa | 20.1% |
| Experimental Example 3 | B | 250° C. | 2.8 | 66° C. | 1506 MPa | 25.9% |
| Experimental Example 4 | C | 350° C. | 0.2 | 119° C. | 1258 MPa | 15.1% |
| Experimental Example 5 | C | 400° C. | 0.1 | 69° C. | 1119 MPa | 35.7% |
| Experimental Example 6 | D | 300° C. | 0.7 | 103° C. | 1383 MPa | 10.7% |
| Experimental Example 7 | D | 350° C. | 0.4 | 53° C. | 1331 MPa | 31.8% |
| Experimental Example 8 | E | 280° C. | 3.0 | 25° C. | 1553 MPa | 26.2% |
| Experimental Example 9 | E | 300° C. | 2.4 | 5° C. | 1677 MPa | 21.5% |

TABLE 2-continued

| Classification | Steel type | Isothermal transformation temperature | t0.5 (hr) | Bs-T | Tensile strength | Elongation |
|---|---|---|---|---|---|---|
| Experimental Example 10 | F | 250° C. | 2.0 | 64° C. | 1812 MPa | 15.9% |
| Experimental Example 11 | F | 280° C. | 1.4 | 34° C. | 1635 MPa | 20.1% |
| Experimental Example 12 | F | 300° C. | 1.1 | 14° C. | 1598 MPa | 26.7% |
| Experimental Example 13 | G | 300° C. | 0.9 | 115° C. | 1504 MPa | 12.1% |
| Experimental Example 14 | G | 350° C. | 0.5 | 65° C. | 1343 MPa | 22.2% |
| Experimental Example 15 | H | 300° C. | 0.6 | 101° C. | 1415 MPa | 13.1% |
| Experimental Example 16 | I | 350° C. | 0.5 | 68° C. | 1452 MPa | 21.4% |
| Experimental Example 17 | J | 300° C. | 0.8 | 117° C. | 1491 MPa | 18.1% |
| Experimental Example 18 | J | 350° C. | 0.5 | 67° C. | 1497 MPa | 27.2% |
| Experimental Example 19 | K | 350° C. | 0.1 | 102° C. | 1333 MPa | 14.6% |
| Experimental Example 20 | K | 400° C. | 0.1 | 52° C. | 1365 MPa | 20.3% |
| Experimental Example 21 | L | 300° C. | 1.8 | 21° C. | 1591 MPa | 15.4% |
| Experimental Example 22 | M | 400° C. | 0.1 | 134° C. | 1170 MPa | 11.0% |
| Experimental Example 23 | N | 400° C. | 0.04 | 115° C. | 1057 MPa | 27.6% |
| Experimental Example 24 | O | 350° C. | 0.3 | 67° C. | 1354 MPa | 13.0% |
| Experimental Example 25 | P | 300° C. | 0.2 | 145° C. | 1378 MPa | 12.2% |
| Experimental Example 26 | P | 350° C. | 0.1 | 95° C. | 1343 MPa | 13.8% |
| Experimental Example 27 | Q | 300° C. | 0.3 | 89° C. | 1396 MPa | 13.2% |
| Experimental Example 28 | Q | 350° C. | 0.3 | 39° C. | 1388 MPa | 14.4% |
| Experimental Example 29 | R | 300° C. | 1.1 | 89° C. | 1475 MPa | 11.8% |
| Experimental Example 30 | S | 350° C. | 0.1 | 67° C. | 1330 MPa | 13.8% |
| Experimental Example 31 | T | 350° C. | 0.2 | 51° C. | 1363 MPa | 15.0% |
| Experimental Example 32 | U | 350° C | 0.1 | 91° C. | 1420 MPa | 16.1% |
| Experimental Example 33 | V | 350° C. | 0.1 | 122° C. | 1326 MPa | 14.3% |
| Experimental Example 34 | W | 400° C. | 0.02 | 129° C. | 1010 MPa | 15.5% |
| Experimental Example 35 | X | 370° C. | 0.05 | 74° C. | 1145 MPa | 14.6% |
| Experimental Example 36 | Y | 370° C. | 0.02 | 138° C. | 1195 MPa | 11.7% |
| Experimental Example 37 | Z | 250° C. | 23.4 | 42° C. | 1790 MPa | 17.1% |
| Experimental Example 38 | Z | 280° C. | 15.9 | 12° C. | 1567 MPa | 23.6% |
| Comparative Example 1 | D | 200° C. | 2.7 | 203° C. | 2059 MPa | 9.5% |
| Comparative Example 2 | D | 250° C. | 1.3 | 153° C. | 1748 MPa | 9.4% |
| Comparative Example 3 | L | 300° C. | 0.2 | 152° C. | 1488 MPa | 9.1% |
| Comparative Example 4 | N | 350° C. | 0.2 | 184° C. | 1279 MPa | 9.1% |
| Comparative Example 5 | O | 350° C. | 0.1 | 165° C. | 1247 MPa | 9.0% |
| Comparative Example 6 | P | 250° C. | 0.8 | 167° C. | 1412 MPa | 7.7% |
| Comparative Example 7 | W | 300° C. | 0.1 | 172° C. | 1482 MPa | 7.6% |
| Comparative Example 8 | AA | 460° C. | 0.01 | 145° C. | 717 MPa | 14.0% |
| Comparative Example 9 | AB | 480° C. | 0.01 | 126° C. | 752 MPa | 12.2% |

TABLE 2-continued

| Classification | Steel type | Isothermal transformation temperature | t0.5 (hr) | Bs-T | Tensile strength | Elongation |
|---|---|---|---|---|---|---|
| Comparative Example 10 | AC | 450° C. | 0.03 | 92° C. | 1150 MPa | 8.5% |

In Table 2, t0.5 represents the time taken for the bainite transformation amount to reach 50 vol %, and Bs-T represents the difference between the bainite transformation starting temperature and the isothermal transformation temperature, i.e., the temperature obtained by subtracting the isothermal transformation temperature from the bainite transformation starting temperature.

In Experimental Examples 1 to 38 of the present invention, the differences between the bainite transformation starting temperature and the isothermal transformation temperature was always 150° C. or less, the tensile strength of the high carbon steel sheet was always 1000 MPa or more, and the elongation percentage was always 10% or more.

In Experimental Examples 1 to 36 of the present invention, the time taken for the bainite transformation amount to reach 50 vol % was three hours or less. Under conditions not satisfying Equation 3, i.e., in Experimental Examples 37 and 38 in which the bainite transformation time was three hours or more, although the transformation time was long and hence the possibility of mass production is low, a strong and highly ductile steel material having a tensile strength of 1000 MPa or more and an elongation percentage of at least 10% can be obtained.

On the other hand, in Comparative Examples 1 to 7, the heat treatment of the high carbon steel sheet was performed at a temperature lower than Bs−150° C., and thus the amount of residual austenite was insufficient and the elongation percentage was less than 10%.

Further, in Comparative Example 8, the tensile strength of the steel sheet was less than 1000 MPa because the carbon content was lower than 0.2 wt %. In Comparative Example 9, the content of carbon was 0.25 wt %, and while the required content of (Mn+Cr+Ni/2) was 2.375 wt %, the actual content of (Mn+Cr+Ni/2) did not reach this value since only 1.5 wt % was added. Consequently, the tensile strength obtained was less than 1000 MPa. In Comparative Example 10, the sum of (Si+Al) was about 0.8 wt %, i.e., less than 1.0 wt %, and a typical bainite structure in which residual austenite does not exist after isothermal transformation was obtained, and the elongation of the steel material did not reach 10%.

As described above, in the experimental examples of the present invention, a high carbon steel sheet having superior strength and ductility could be manufactured within a short time. Meanwhile, in the comparative examples, elongation of the high carbon steel sheet was degraded or sufficient tensile strength could not be achieved.

While the present invention has been described with reference to exemplary embodiments thereof, it will be understood by those of skill in the art that various modifications can be made to the disclosed embodiments without departing from the concept and scope of the present invention.

What is claimed is:

1. A high carbon steel sheet comprises 0.2 to 1.0 wt % carbon (C), greater than about 1 wt % and less than or equal to 3.0 wt % silicon (Si), greater than 0 wt % and less than or equal to 3.0 wt % manganese (Mn), greater than 0 wt % and less than or equal to 3.0 wt % chromium (Cr), greater than 0 wt % and less than or equal to 3.0 wt % nickel (Ni), greater than 0 wt % and less than or equal to 0.5 wt % molybdenum (Mo), greater than about 1 wt % and less than or equal to 3.0 wt % aluminum (Al), greater than 0 wt % and less than or equal to 0.01 wt % boron (B), greater than 0 wt % and less than or equal to 0.5 wt % titanium (Ti), and the remainder substantially being iron (Fe) and inevitable impurities, the contents of carbon, manganese, chromium, and nickel satisfy the following Equation 1, and the contents of silicon and aluminum satisfy the following Equation 2, and the carbon (C), manganese (Mn), chromium (Cr), nickel (Ni), and aluminum (Al) satisfy the following equation 3:

$$(3.0-2.5\times C)\text{wt }\% \leqq (Mn+Cr+Ni/2)8.5\text{ wt }\% \quad \text{(Equation 1)}$$

$$Si+Al > \text{about } 2.0\text{ wt }\% \quad \text{(Equation 2)},$$

$$\text{Log 10 [50\% transformation time (sec)]} = -2.742 + 3.561\times C + 0.820\times Mn + 0.416\times Cr + 0.402\times Ni - 0.332\times Al + 1330/(T+273) \leqq Log_{10}[3\times 3600] \quad \text{(Equation 3)},$$

wherein T is a temperature in degrees Celsius and represents a transformation temperature, and 50% transformation time is a minimum time required for 50% transformation into bainite.

2. The high carbon steel sheet of claim 1, wherein the high carbon steel sheet comprises a fine microstructure, the fine microstructure comprises residual austenite, and the volume percentage of the residual austenite in the fine microstructure ranges from 15 vol % to 50 vol %.

3. The high carbon steel sheet of claim 2, wherein the fine microstructure further comprises bainite, and the bainite ranges from 50 vol % to 85 vol %.

4. The high carbon steel sheet of claim 3, wherein the tensile strength of the high carbon steel sheet is greater than 1000 MPa, and the elongation thereof is greater than 10%.

5. The high carbon steel sheet of claim 4, wherein the titanium (Ti) and nitrogen (N) satisfy the following Equation 6:

$$Ti(\text{wt }\%) > N(\text{wt }\%)\times 3.42 \quad \text{(Equation 6)}.$$

6. The high carbon steel sheet of claim 4, wherein the carbon (C) in the composition of the high carbon steel sheet ranges from 0.4 wt % to 1.0 wt %, and the contents of the manganese (Mn), chromium (Cr), and nickel (Ni), satisfy the following equation:

$$1.5\text{ wt }\% \leqq (Mn+Cr+Ni/2) \leqq 8.5\text{ wt }\%.$$

7. The high carbon steel sheet of claim 4, wherein the carbon (C) in the composition of the high carbon steel sheet ranges from 0.2 wt % to 0.7 wt %, and the contents of the manganese (Mn), chromium (Cr), and nickel (Ni) satisfy the following equation:

$$3.0\text{ wt }\% \leqq (Mn+Cr+Ni/2) \leqq 8.5\text{ wt }\%.$$

8. A method for manufacturing a high carbon steel sheet, comprising:

i) preparing a high carbon steel sheet comprising 0.2 to 1.0 wt % carbon (C), greater than about 1 wt % and less than or equal to 3.0 wt % silicon (Si), greater than 0 wt % and less than or equal to 3.0 wt % manganese (Mn), greater than 0 wt % and less than or equal to 3.0 wt % chromium (Cr), greater than 0 wt % and less than or equal to 3.0 wt % nickel (Ni), greater than 0 wt % and less than or equal to 0.5 wt % molybdenum (Mo), greater than about 1 wt % and less than or equal to 3.0 wt % aluminum (Al), greater than 0 wt % and less than or equal to 0.01 wt % boron (B), greater than 0 wt % and less than or equal to 0.5 wt % titanium (Ti), and the remainder substantially being iron (Fe) and inevitable impurities;

ii) austenitizing the high carbon steel sheet;

iii) cooling the high carbon steel sheet while maintaining the austenite structure; and iv) isothermally transforming the austenitized high carbon steel sheet in a temperature range from 150° C. below the bainite transformation starting temperature to the bainite transformation starting temperature, wherein the contents of carbon, manganese, chromium, and nickel satisfy the following Equation 1, and the silicon and the aluminum satisfy the following Equation 2, and the carbon (C), manganese (Mn), chromium (Cr), nickel (Ni), and aluminum (Al) satisfy the following Equation 3:

$$(3.0-2.5\times C)\text{wt }\% \leqq (Mn+Cr+Ni/2) \leqq 8.5\text{ wt }\% \quad \text{(Equation 1)}$$

$$Si+Al > \text{about } 2.0\text{ wt }\% \quad \text{(Equation 2)},$$

$$\text{Log 10 [50\% transformation time (sec)]} = -2.742 + 3.561\times C + 0.820\times Mn + 0.416\times Cr + 0.402\times Ni - 0.332\times Al + 1330/(T+273) \leqq \text{Log}_{10}[3\times 3600] \quad \text{(Equation 3)},$$

wherein T is a temperature in degrees Celsius and represents a transformation temperature, and 50% transformation time is a minimum time required for 50% transformation into bainite.

9. The method of claim 8, wherein, in the isothermal transformation, the isothermal transformation is carried out for one minute to 48 hours.

10. The method of claim 9, wherein, during the isothermal transformation, the bainite transformation of the high carbon steel sheet is finished at greater than 50 vol % and less than 100 vol %.

11. The method of claim 10, wherein the time taken to complete 50 vol % bainite transformation of the high carbon steel sheet is more than one minute and less than three hours.

12. The method of claim 9, wherein the bainite transformation starting temperature satisfies the following equation:

$$\text{bainite transformation starting temperature (Bs) (°C.)} = 830 - 270\times C(\text{wt }\%)\ 90\times Mn(\text{wt }\%) - 37\times Ni(\text{wt }\%) - 70\times Cr(\text{wt }\%) - 83\times Mo(\text{wt }\%).$$

13. The method of claim 8, wherein the cooling is performed on a run-out table at a cooling speed of 10-50°/sec.

14. The method of claim 13, wherein the isothermal transformation is performed by coiling the high carbon steel sheet.

15. The method of claim 14, wherein the bainite transformation starting temperature satisfies the following equation:

$$\text{bainite transformation starting temperature (Bs) (°C.)} = 830 - 270\times C(\text{wt }\%) - 90\times Mn(\text{wt }\%) - 37\times Ni(\text{wt }\%) - 70\times Cr(\text{wt }\%) - 83\times Mo(\text{wt }\%).$$

16. The high carbon steel sheet of claim 1, wherein the content of at least one of silicon and aluminum is greater than 1.0 wt % and less than or equal to 3.0 wt %.

17. The method of claim 8, wherein the content of at least one of silicon and aluminum is greater than 1.0 wt % and less than or equal to 3.0 wt %.

* * * * *

UNITED STATES PATENT AND TRADEMARK OFFICE

CERTIFICATE OF CORRECTION

PATENT NO. : 8,465,601 B2
APPLICATION NO. : 12/745621
DATED : June 18, 2013
INVENTOR(S) : Young-Roc Im et al.

It is certified that error appears in the above-identified patent and that said Letters Patent is hereby corrected as shown below:

On the Title Page, Column 2, Item (57) Abstract, Line 12, delete "Si+Al>1.0 wt %" and insert -- Si+Al>about 2.0 wt % --

In the Claims:

Column 24, Line 23, Claim 1, delete "(Mn+Cr+Ni/2)8.5 wt%" and insert -- (Mn+Cr+Ni/2) ≤8.5 wt% --

Column 26, Line 15, Claim 12, delete "90×Mn(wt %)" insert -- –90×Mn(wt %) --

Column 26, Line 18, Claim 13, delete "10-50°/sec." and insert -- 10-50°C/sec. --

Signed and Sealed this
First Day of October, 2013

Teresa Stanek Rea

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,465,601 B2
APPLICATION NO. : 12/745621
DATED : June 18, 2013
INVENTOR(S) : Im et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 102 days.

Signed and Sealed this
Eighth Day of September, 2015

Michelle K. Lee

Michelle K. Lee
*Director of the United States Patent and Trademark Office*